United States Patent [19]

McArthur, Sr. et al.

[11] Patent Number: 4,780,970

[45] Date of Patent: Nov. 1, 1988

[54] SHOE PROTECTOR

[76] Inventors: Douglas C. McArthur, Sr., 6195 Spout Springs Rd., Flowery Branch, Ga. 32504; Willard R. McArthur, Sr., 2698 Camlot Ct., Duluth, Ga. 30136

[21] Appl. No.: 54,755

[22] Filed: May 26, 1987

[51] Int. Cl.[4] ..... A43B 13/22

[52] U.S. Cl. ..... 36/72 R

[58] Field of Search ..... 36/72 R, 72 B, 71.5, 36/77 R

[56] References Cited

U.S. PATENT DOCUMENTS

| | | | |
|---|---|---|---|
| 461,492 | 10/1891 | Browning | 36/72 R |
| 745,442 | 12/1903 | Innes | 36/72 R |
| 756,198 | 4/1904 | Adams | 36/72 R |
| 820,250 | 5/1906 | Patterson | 36/72 R |
| 900,499 | 10/1908 | Eckhard, Jr. | 36/72 R |
| 1,030,892 | 7/1912 | Kennedy | 36/72 R |
| 1,326,542 | 12/1919 | Stebor, Jr. | 36/72 R |
| 2,268,435 | 12/1941 | Zucker | 36/7.2 |
| 2,344,069 | 3/1944 | Wasser | 36/72 R |
| 2,552,700 | 5/1951 | Watts | 36/72 |
| 2,723,469 | 11/1955 | Shusterman | 36/72 |
| 3,045,367 | 7/1962 | McKeon | 36/72 R |
| 3,126,651 | 3/1964 | Bown et al. | 36/72 |
| 3,324,579 | 6/1967 | Steininger | 36/72 R |
| 4,005,534 | 2/1977 | Crist et al. | 36/72 R |
| 4,069,599 | 1/1978 | Alegria | 36/72 R |
| 4,249,321 | 2/1987 | Nagy | 36/72 B |
| 4,638,574 | 1/1987 | Roda | 36/72 R |

FOREIGN PATENT DOCUMENTS

| | | | |
|---|---|---|---|
| 34820 | 5/1908 | Fed. Rep. of Germany | 36/72 B |
| 148122 | 12/1954 | Sweden | 36/72 R |
| 21814 | of 1901 | United Kingdom | 36/72 R |

*Primary Examiner*—Steven N. Meyers

*Attorney, Agent, or Firm*—Kilpatrick & Cody

[57] ABSTRACT

A shoe protector for carpet installers and others whose shoe toes are subject to abrasion and chemical abuse. The protector cup includes a pair of superior stabilizers connected to the top of the protector cup and a pair of inferior stabilizers connected to the bottom of the protector cup. A superior and inferior stabilizer are each connected to a stabilizer ring which is in turn connected to a heel strap linking the two stabilizer rings. The stabilizer rings translate the rearward force of the heel strap into pulling forces on the superior and inferior stabilizers in order to allow the protector cup to be pulled not only rearward against the toe of the shoe, but also downward against the shoe toe top and upward against the shoe toe bottom for maximum gripping effect on the shoe.

5 Claims, 2 Drawing Sheets

SHOE PROTECTOR

This invention relates to shoe protectors for use in carpet laying operations or other activities which require that shoe or boot toes be protected against abrasion, chemical agents and other abuse.

BACKGROUND OF THE INVENTION

Carpet installers and others who spend time on their knees subject the toes of their shoes or boots to tremendous wear. The shoe toe typically wears through long before the remainder of the shoe reaches the end of its service life.

Carpet installers often purchase inexpensive shoes such as sneakers in an effort to economize because of their shoes' short life spans. Such shoes often lack the support and protection found in more expensive and substantial shoes, however, and they expose the installers' feet to unnecessary abuse.

Carpet installers also require shoe toes which provide them traction and stability on the carpet being installed or removed. For example, carpet installers often use a kicker bar when securing carpet to tacking strips. A kicker bar includes a head from whose bottom protrude forward slanting spikes or nails which grab the carpet. The head is secured by a longitudinal handle to a rear knee block. The carpet installer supports and stabilizes himself with the knee and toe of one leg and with his opposite arm which forces the head of the kicker bar into the carpet. He then kicks the knee block of the kicker bar repeatedly with his free leg to force the carpet taut across the room and onto angle nails of the tacking strips which hold the carpet in place. The toe of the stabilizing leg must therefore have a secure purchase on the carpet so that the installer does not slide or move as he kicks the kicker bar. Similarly, an installer pulling carpet from the floor depends on his shoe toes to keep him from sliding on the carpet as he exerts force against the carpet he is removing.

Carpet installers' shoes also suffer abuse from another source; adhesive and other chemicals utilized in carpet laying and removing operations add to the wear and tear of carpet installers' shoes.

SUMMARY OF THE INVENTION

Shoe protectors of the present invention utilize a toe cup held in place by inferior stabilizers and superior stabilizers to protect shoe toes against abrasion and chemical abuse. The inferior and superior stabilizers are tensioned by a stabilizer ring to pull the toe cup into place. The stabilizer ring is in turn tensioned by an adjustable heel strap. The stabilizer ring translates the substantially horizontal (with respect to the shoe) rearward tension exerted by heel strap into upward and rearward force components to pull the inferior stabilizer against the front and bottom of the shoe, and into downward and rearward components to pull the superior stabilizer against the front and top of the shoe. The toe cup is thus held firmly in place so that the shoe protector does not detract from the carpet installer's ability to use his shoe toes for sturdying himself on the carpet.

It is therefore an object of the present invention to provide a shoe or boot protector for use in carpet installation or other operations where protection against abrasion, chemical agents and other shoe or boot toe abuse is desired.

It is an additional object of the present invention to provide a shoe or boot protector which remains tightly secured to the shoe toe with minimum discomfort to the wearer.

It is an additional object of the present invention to provide a shoe or boot toe protector which uses a stabilizer ring to pull the shoe toe protector cup upwardly against the bottom of the shoe and downwardly against the top of the shoe to hold the protector cup tightly against the shoe toe.

It is an additional object of the present invention to provide a shoe or boot toe protector made of material which resists abuse from chemicals and other agents.

Other objects, features and advantages of the present invention will become apparent with reference to the remainder of the written portion and drawings of this document.

DETAILED DESCRIPTION OF THE DRAWINGS

Figure 1:
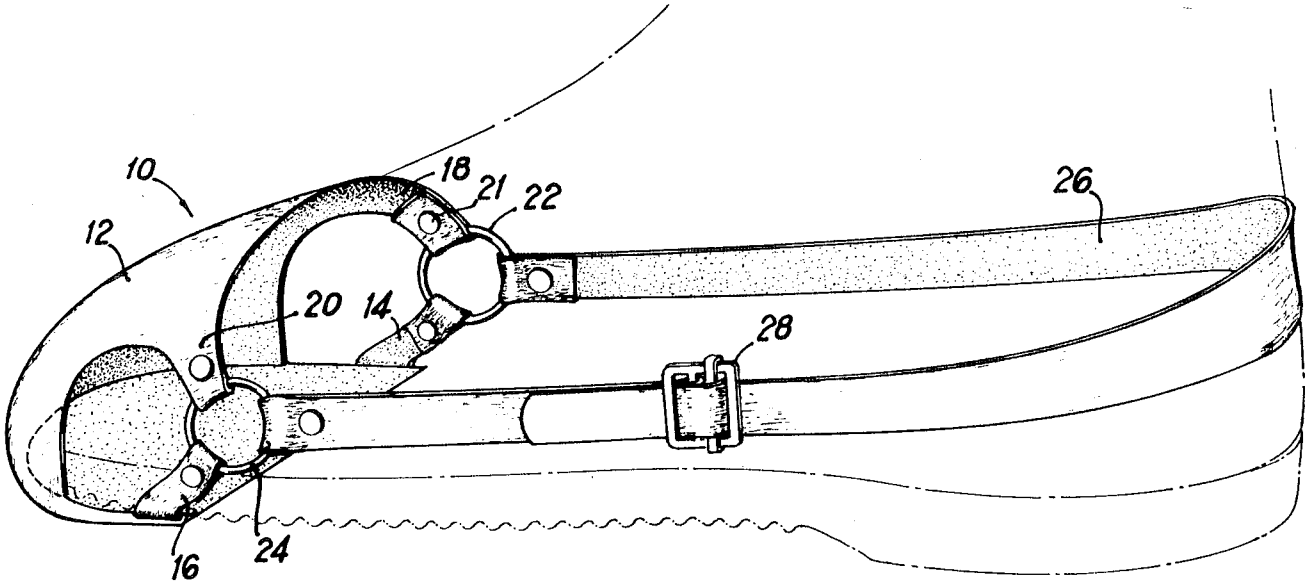
FIG. 1 is a perspective view of a preferred embodiment of a shoe protector according to the present invention.

FIG. 1 is a perspective view of a preferred embodiment of a shoe protector according to the present invention. Protector cup 12 fits around the toe of the shoe to be protected. Protector cup 12 is connected on its bottom surface to a medial inferior stabilizer 14 and a lateral inferior stabilizer 16. Its top surface is connected to a medial superior stabilizer 18 and a lateral superior stabilizer 20. Cup 12 and stabilizers may be formed in a unit and may be made of any desirable material which is resistant to abrasion and chemicals. A preferred material is SBR or styrene-butadine rubber.

Medial inferior stabilizer 14 and medial superior stabilizer 18 are connected to a medial stabilizer ring 22. Similarly, lateral inferior stabilizer 16 and lateral superior stabilizer 20 are connected to a lateral stabilizer ring 24. Stabilizer rings 22 and 24 are preferably metallic, but they may also be formed of other materials such as loops of leather or polymeric materials. Stabilizer rings 22 and 24 in turn are connected to a heel strap 26. Heel strap 26 extends from medial stabilizer ring 22, around the heel of the shoe to be protected, to lateral stabilizing 24. Heel strap 26 may contain a buckle or other closure device to allow heel strap 26 to be adjustable and to aid in putting the toe protector 10 on. The closure device should be located on the lateral portion of the heel strap 26. The strap 26 can be formed of a woven, natural or synthetic material, or it can be formed of leather or other desired materials. A slip wedge buckle is convenient to use as closure device 28 because it can be easily adjusted and disconnected.

Figure 4:
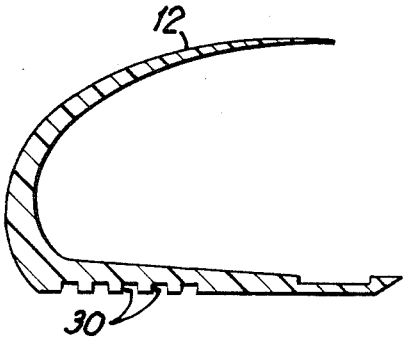
FIG. 4 is a side cross sectional view of a portion of the protector of FIG. 1.
Figure 5:
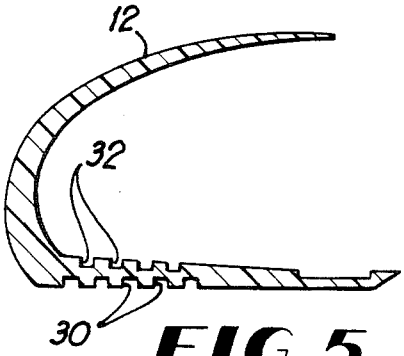
FIG. 5 is a side cross sectional view of a protector according to a second embodiment of the present invention which has ridges on the interior of the protector cup.

Protector cup 12 may include exterior gripping surfaces 30 such as ridges protruding from the interior exterior surfaces of protector cup 12. These surfaces 30 aid the wearer in gaining traction with the protector 10. Such surfaces are shown in FIG. 4. FIG. 5 shows the use of interior gripping surfaces 32 to allow cup 12 to grip the shoe more effectively. Gripping surfaces 30 and 32 may not be needed on cups 12 made of material having a high coefficient of friction, but they can be helpful in other cups made of materials such as, for instance, silicone plastics or rubber.

Figure 2:
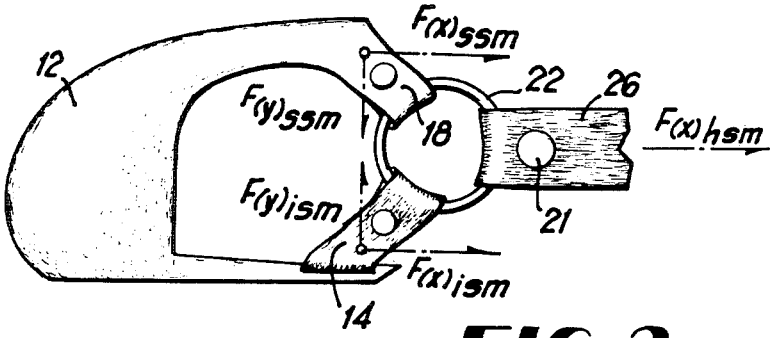
FIG. 2 is a side elevational view of a portion of the protector of FIG. 1.
Figure 3:
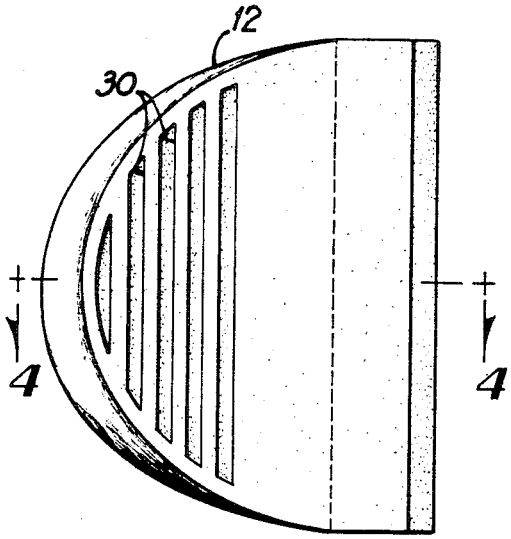
FIG. 3 is a bottom plan view of the protector of FIG. 1.

FIGS. 1 and 2 show the operation of stabilizer rings 22 and 24 in securing cup 12 to the toe of the shoe to be protected. Heel strap 26 exerts rearward longitudinal force F(x)hsm on stabilizer ring 22. Stabilizer ring 22 in turn pulls on medial inferior stabilizer 14 and medial superior stabilizer 18. Force F(x)hsm is thus translated into two component horizontal forces; F(x)hsm on medial superior stabilizer and F(x)ism on medial inferior stabilizer. These two component longitudinal forces may or may not be equivalent.

Vertical components F(y)ssm and F(y)ism on medial superior stabilizer 18 and medial inferior stabilizer 14, respectively, cancel each other. Heel strap 26 thus causes stabilizers 14 and 16 to pull protector cup 12 rearward against the toe of the shoe, upward against the bottom of the shoe and downward against the top of the shoe for maximum gripping effect. Heel strap 26 accomplishes this without the need for other stabilizing straps around the ankle or bottom of the foot, and it thus makes protector 10 easier to put on and more confortable to wear. The magnitude of the rearward force on heel strap 26 may be adjusted utilizing closure device 28.

The foregoing is provided for purposes of illustration and explanation. Modifications, adaptations and changes may be made to the invention as described without departing from its scope and spirit.

What is claimed is:

1. A shoe protector comprising:

(a) an elastic protector cup for enclosing the toe of the shoe to be protected;

(b) a pair of superior stabilizers connected to the top of the protector cup for pulling the cup downward against the top of the shoe toe and rearward against the shoe toe;

(c) a pair of inferior stabilizers connected to the bottom of the protector cup for pulling the cup upward against the bottom of the shoe toe and rearward against the shoe toe;

(d) a pair of stabilizer rings, each connecting a superior and an inferior stabilizer; and (e) a heel strap attached to both stabilizer rings for applying rearward force on the rings.

2. A shoe protector according to claim 1 further comprising a plurality of gripping ridges located on the bottom exterior surface of the shoe protector cup.

3. A shoe protector according to claim 1 further comprising a plurality of gripping ridges located on the interior surface of the shoe protector cup.

4. A shoe protector according to claim 1 in which the heel strap further comprises an adjustable closure for controlling the rearward force placed on the stabilizer rings by the heel strap.

5. A shoe protector comprising:

(a) an elastic protector cup for enclosing the toe of the shoe to be protected, having a plurality of ridges on its bottom exterior surface and on its interior surface for increasing the friction coefficient of those surfaces of the cup;

(b) a pair of superior stabilizers connected to the top of the protector cup for pulling the cup downward against the top of the shoe toe and rearward against the shoe toe;

(c) a pair of inferior stabilizers connected to the bottom of the protector cup for pulling the cup upward against the bottom of the shoe toe and rearward against the shoe toe;

(d) a pair of stabilizer rings, each connecting a superior and inferior stabilizer; and (e) an adjustable heel strap attached to both stabilizer rings for applying rearward force on the rings and having a closure device for adjusting the magnitude of the rearward force.

* * * * *